US008388307B2

(12) United States Patent
Smoke et al.

(10) Patent No.: US 8,388,307 B2
(45) Date of Patent: Mar. 5, 2013

(54) TURBINE NOZZLE ASSEMBLY INCLUDING RADIALLY-COMPLIANT SPRING MEMBER FOR GAS TURBINE ENGINE

(75) Inventors: Jason Smoke, Phoenix, AZ (US); Stony Kujala, Tempe, AZ (US); Gregory O. Woodcock, Mesa, AZ (US); Bradley Reed Tucker, Chandler, AZ (US)

(73) Assignee: Honeywell International Inc., Morristown, NJ (US)

( * ) Notice: Subject to any disclaimer, the term of this patent is extended or adjusted under 35 U.S.C. 154(b) by 881 days.

(21) Appl. No.: 12/506,904

(22) Filed: Jul. 21, 2009

(65) Prior Publication Data

US 2011/0020118 A1 Jan. 27, 2011

(51) Int. Cl.
*F01D 25/24* (2006.01)

(52) U.S. Cl. ..... 415/135; 415/134; 415/209.2; 60/799; 60/800

(58) Field of Classification Search ..... 415/134, 415/135, 136, 137, 170.1, 173.7, 174.1, 174.2, 415/174.3, 191, 209.2, 209.3, 209.4, 214.1; 60/752, 796, 799, 800, 804, 805
See application file for complete search history.

(56) References Cited

U.S. PATENT DOCUMENTS

| | | | |
|---|---|---|---|
| 4,373,575 | A | 2/1983 | Hayes |
| 4,534,700 | A | 8/1985 | Horler et al. |
| 4,821,522 | A | 4/1989 | Matthews et al. |
| 4,863,345 | A | 9/1989 | Thompson et al. |
| 5,118,120 | A | 6/1992 | Drerup et al. |
| 5,149,250 | A | 9/1992 | Plemmons et al. |
| 5,289,677 | A | 3/1994 | Jarrell |
| 5,480,162 | A | 1/1996 | Beeman, Jr. |
| 5,765,833 | A | 6/1998 | Able et al. |
| 6,116,852 | A | 9/2000 | Pierre et al. |
| 6,464,232 | B1 | 10/2002 | Marchi et al. |
| 6,547,257 | B2 | 4/2003 | Cromer |
| 6,652,231 | B2 | 11/2003 | Vedantam et al. |
| 6,752,592 | B2 | 6/2004 | Mohammed-Fakir et al. |
| 6,823,676 | B2 * | 11/2004 | Conete et al. ..... 60/796 |
| 6,854,738 | B2 | 2/2005 | Matsuda et al. |
| 6,895,757 | B2 | 5/2005 | Mitchell et al. |
| 6,895,761 | B2 | 5/2005 | Mitchell et al. |
| 6,920,762 | B2 | 7/2005 | Wells et al. |
| 6,942,445 | B2 | 9/2005 | Morris et al. |
| 7,040,098 | B2 | 5/2006 | Lepretre et al. |
| 7,073,336 | B2 | 7/2006 | Lepretre et al. |

(Continued)

OTHER PUBLICATIONS

USPTO Office Action for U.S. Appl. No. 12/481,441, dated Dec. 19, 2012.

*Primary Examiner* — Christopher Verdier
*Assistant Examiner* — Jason Davis
(74) *Attorney, Agent, or Firm* — Ingrassia Fisher & Lorenz, P.C.

(57) ABSTRACT

Embodiments of a turbine nozzle assembly are provided for deployment within a gas turbine engine (GTE) including a first GTE-nozzle mounting interface. In one embodiment, the turbine nozzle assembly includes a turbine nozzle flowbody, a first mounting flange configured to be mounted to the first GTE-nozzle mounting interface, and a first radially-compliant spring member coupled between the turbine nozzle flowbody and the first mounting flange. The turbine nozzle flowbody has an inner nozzle endwall and an outer nozzle endwall, which is fixedly coupled to the inner nozzle endwall and which cooperates therewith to define a flow passage through the turbine nozzle flowbody. The first radially-compliant spring member accommodates relative thermal movement between the turbine nozzle flowbody and the first mounting flange to alleviate thermomechanical stress during operation of the GTE.

17 Claims, 5 Drawing Sheets

U.S. PATENT DOCUMENTS

| | | | | |
|---|---|---|---|---|
| 7,090,224 | B2 | 8/2006 | Iguchi et al. | |
| 7,128,323 | B2 | 10/2006 | Iguchi et al. | |
| 7,140,840 | B2 | 11/2006 | Taillant et al. | |
| 7,178,340 | B2 | 2/2007 | Jorgensen | |
| 7,197,882 | B2 | 4/2007 | Marnas et al. | |
| 7,497,443 | B1 | 3/2009 | Steinetz et al. | |
| 2002/0184892 | A1* | 12/2002 | Calvez et al. | 60/796 |
| 2003/0005705 | A1 | 1/2003 | Chan et al. | |
| 2009/0026713 | A1 | 1/2009 | Fujimoto et al. | |

* cited by examiner

TURBINE NOZZLE ASSEMBLY INCLUDING RADIALLY-COMPLIANT SPRING MEMBER FOR GAS TURBINE ENGINE

STATEMENT REGARDING FEDERALLY SPONSORED RESEARCH OR DEVELOPMENT

This invention was made with Government support under Contract No. W911W6-08-2-0001 awarded by the Department of Defense. The Government has certain rights in this invention.

TECHNICAL FIELD

The present invention relates generally to gas turbine engines and, more particularly, to embodiments of a turbine nozzle assembly having at least one radially-compliant spring member.

BACKGROUND

In one well-known type of gas turbine engine (GTE), at least one high pressure turbine (HPT) nozzle is mounted within an engine casing between a combustor and a high pressure (HP) air turbine. In single nozzle GTE platforms, the HPT nozzle typically includes an annular nozzle flowbody having an inner nozzle endwall and an outer nozzle endwall, which circumscribes the inner nozzle endwall. A plurality of circumferentially spaced stator vanes extends between the outer and inner nozzle endwalls and cooperates therewith to define a number of flow passages through the nozzle flowbody. The HPT nozzle further includes one or more radial mounting flanges, which extend radially outward from the HPT nozzle flowbody. The radial mounting flanges are each rigidly joined to a different end portion of the nozzle flowbody and may be integrally formed therewith as a unitary machined piece. When the GTE is assembled, the radial mounting flanges are each attached (e.g., bolted) to corresponding GTE-nozzle mounting interfaces (e.g., inner walls) provided within the GTE to secure the HPT nozzle within the engine casing.

During GTE operation, the HPT nozzle conducts combustive gas flow from the combustor into the HP air turbine. The combustive gas flow convectively heats the inner surfaces of the combustor and the HPT nozzle flowbody to highly elevated temperatures. At the same time, the HPT nozzle's radial mounting flanges and the GTE-nozzle mounting interfaces are cooled by bypass air flowing over and around the combustor. Significant temperature gradients thus occur within the GTE during operation, which result in relative thermal movement (also referred to as "thermal distortion") between the HPT nozzle, the GTE-nozzle mounting interfaces, and the trailing end of the combustor. Due to their inherent rigidity, conventional HPT nozzles of the type described above are often unable to adequately accommodate such thermal distortion and, as a result, can experience relatively rapid thermomechanical fatigue and reduced operational lifespan. In addition, thermal distortion between the HPT nozzle, the combustor end, and the GTE-nozzle mounting interfaces can result in the formation of leakage paths, even if such mating components fit closely in a non-distorted, pre-combustion state. Compression seals may be disposed between the nozzle mounting flanges and the GTE-nozzle mounting interfaces to minimize the formation of leakage paths. However, the sealing characteristics of the compression seals can be compromised when the nozzle mounting flanges, and specifically when the mounting flange sealing surfaces contacting the compression seals, are heated to elevated temperatures by combustive gas flow through the turbine nozzle flowbody. Although the radial height of the mounting flanges can be increased to further thermally isolate the flange sealing surfaces from the combustive gas flow, increasing the height of the radial mounting flanges undesirably increases the overall envelope of the HPT nozzle and consumes a greater volume of the limited space available within the engine casing.

There thus exists an ongoing need to provide a turbine nozzle or turbine nozzle assembly capable of accommodating the relative thermal movement between the turbine nozzle and the GTE-turbine nozzle mounting interface during GTE operation. Preferably, embodiments of such a turbine nozzle assembly would be relatively compact while providing a mounting flange sealing surface sufficiently thermally isolated from the combustive gas flow to prevent overheating of any compression seals disposed between the mounting flange and the GTE-turbine nozzle mounting interface. Other desirable features and characteristics of the present invention will become apparent from the subsequent Detailed Description and the appended Claims, taken in conjunction with the accompanying Drawings and this Background.

BRIEF SUMMARY

Embodiments of a turbine nozzle assembly are provided for deployment within a gas turbine engine (GTE) including a first GTE-nozzle mounting interface. In one embodiment, the turbine nozzle assembly includes a turbine nozzle flowbody, a first mounting flange configured to be mounted to the first GTE-nozzle mounting interface, and a first radially-compliant spring member coupled between the turbine nozzle flowbody and the first mounting flange. The turbine nozzle flowbody has an inner nozzle endwall and an outer nozzle endwall, which is fixedly coupled to the inner nozzle endwall and which cooperates therewith to define a flow passage through the turbine nozzle flowbody. The first radially-compliant spring member accommodates relative thermal movement between the turbine nozzle flowbody and the first mounting flange to alleviate thermomechanical stress during operation of the GTE.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description.

Figure 1:
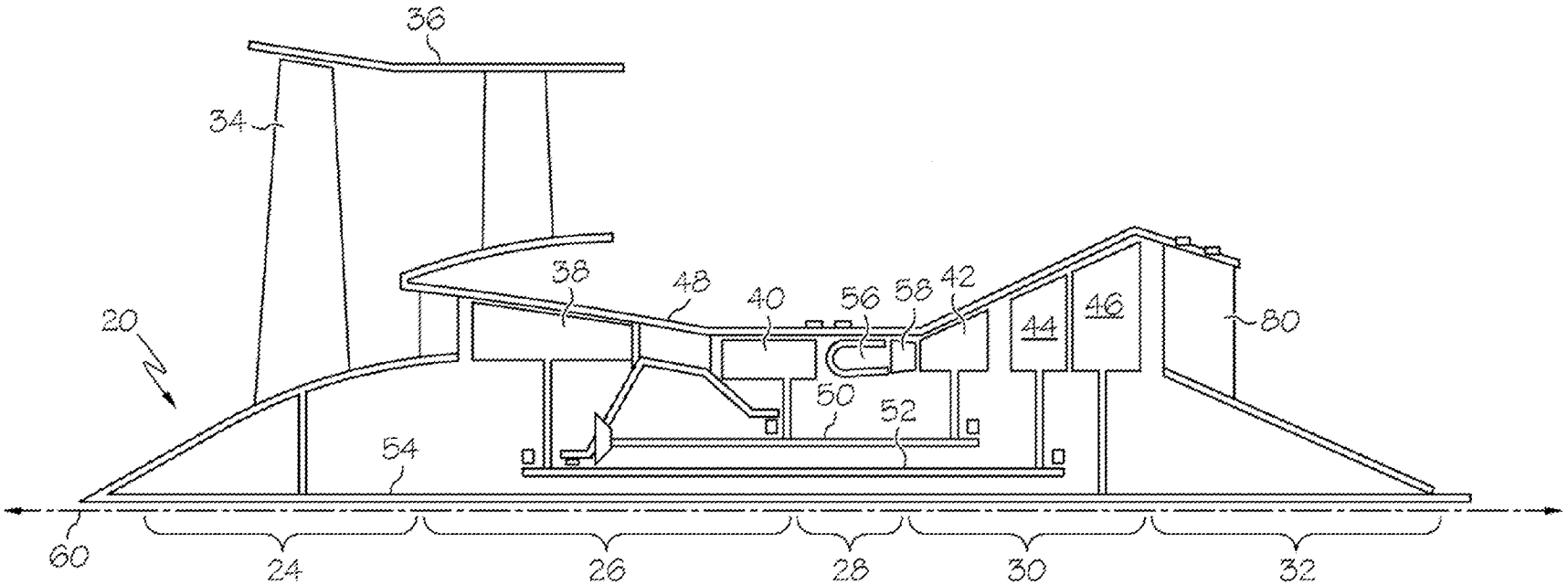
FIG. 1 is a generalized cross-sectional view of the upper portion of a generalized gas turbine engine including a high pressure turbine (HPT) nozzle assembly in accordance with an exemplary embodiment.

FIG. 1 is a generalized cross-sectional view of the upper portion of an exemplary gas turbine engine (GTE) 20. In the exemplary embodiment illustrated in FIG. 1, GTE 20 assumes the form of a three spool turbofan engine including an intake section 24, a compressor section 26, a combustion section 28, a turbine section 30, and an exhaust section 32. Intake section 24 includes a fan 34, which may be mounted within an outer fan case 36. Compressor section 26 includes an intermediate pressure (IP) compressor 38 and a high pressure (HP) compressor 40; and turbine section 30 includes an HP turbine 42, an IP turbine 44, and a low pressure (LP) turbine 46. IP compressor 38, HP compressor 40, HP turbine 42, IP turbine 44, and LP turbine 46 are disposed within a main engine casing 48 in axial flow series. HP compressor 40 and HP turbine 42 are mounted on opposing ends of an HP shaft or spool 50; IP compressor 38 and IP turbine 44 are mounted on opposing ends of an IP spool 52; and fan 34 and LP turbine 46 are mounted on opposing ends of a LP spool 54. LP spool 54, IP spool 52, and HP spool 50 are substantially co-axial. More specifically, LP spool 54 extends through a longitudinal channel provided through IP spool 52, and IP spool 52 extends through a longitudinal channel provided through HP spool 50. Combustion section 28 and turbine section 30 further include a combustor 56 and a high pressure turbine (HPT) nozzle assembly 58, respectively. In the illustrated example, combustor 56 and HPT nozzle assembly 58 each have a generally annular shape and are substantially co-axial with the longitudinal axis of GTE 20 (represented in FIG. 1 by dashed line 60).

As illustrated in FIG. 1 and described herein, GTE 20 is offered by way of example only. It will be readily appreciated that embodiments of the present invention are equally applicable to various other types of gas turbine engine including, but not limited to, other types of turbofan, turboprop, turboshaft, and turbojet engines. Furthermore, the particular structure of GTE 20 will inevitably vary amongst different embodiments. For example, in certain embodiments, an open rotor configuration may be employed wherein fan 34 is not mounted within an outer fan case. In other embodiments, the GTE may employ radially disposed (centrifugal) compressors instead of axial compressors. In still further embodiments, GTE 20 may not include a single annular turbine nozzle and may instead include a number of turbine nozzles, which are circumferentially arranged around the longitudinal axis of GTE 20 and each sealingly coupled to annular combustor 56.

Figure 2:
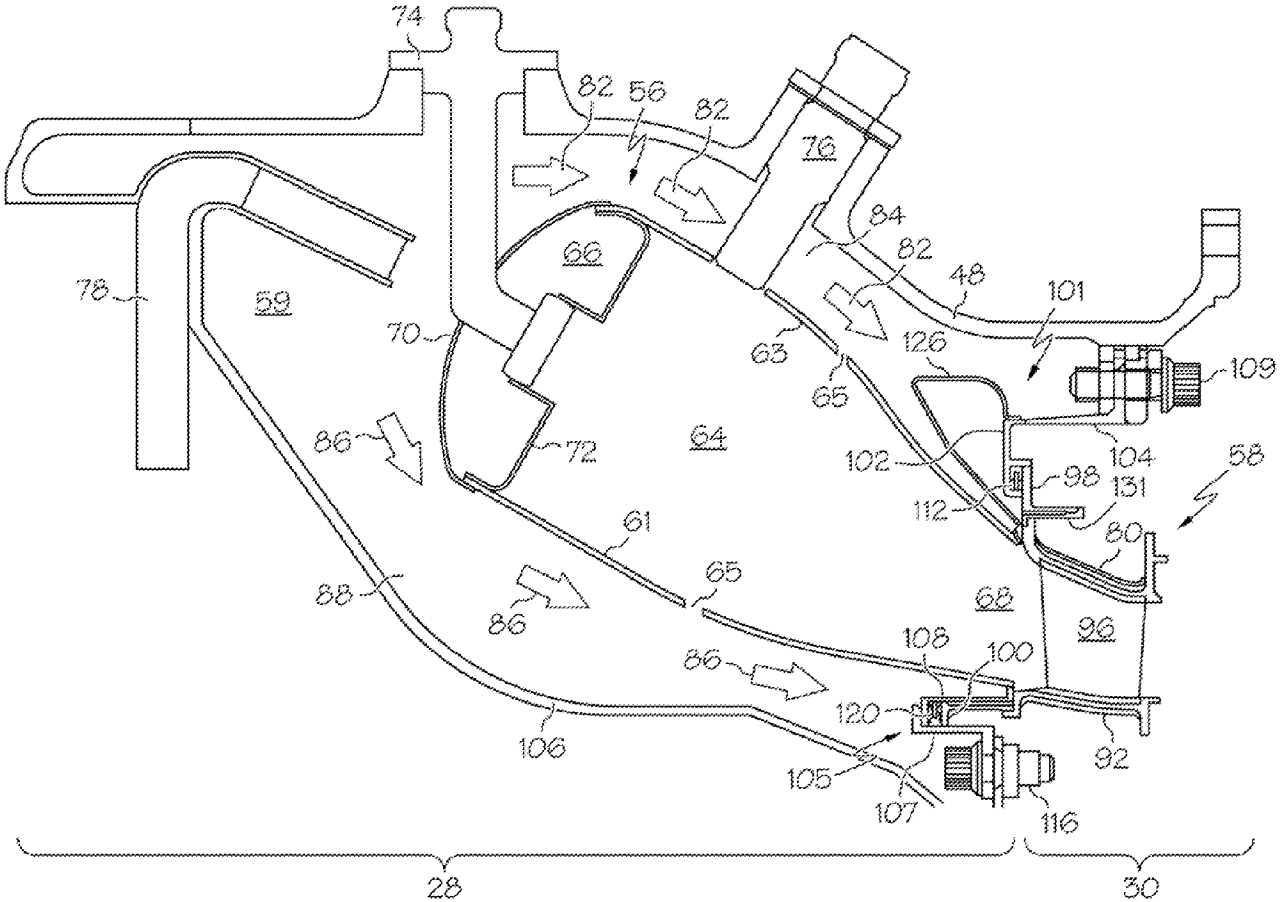
FIG. 2 is a cross-sectional view of an upper portion of the combustor section and the exemplary HPT nozzle assembly included in the GTE shown in FIG. 1.

FIG. 2 is a simplified cross-sectional view of an upper portion of combustion section 28 and HPT nozzle assembly 58. As can be seen in FIG. 2, combustor 56 is mounted within a cavity 59 provided within engine casing 48. Combustor 56 includes an inner liner wall 61 and an outer liner wall 63, which each have a generally conical shape. Outer liner wall 63 circumscribes inner liner wall 61 to define an annular combustion chamber 64 within combustor 56. As is conventionally known, liner walls 61 and 63 may be formed from a temperature-resistant material (e.g., a ceramic, a metal, or an alloy, such as a nickel-based super alloy), and the interior of liner walls 61 and 63 may each be coated with a thermal barrier coating (TBC) material, such as a friable grade insulation. Additionally, a number of small apertures 65 may be formed through liner walls 61 and 63 (e.g., via a laser drilling process) for effusion cooling or aerodynamic purposes (only two effusion cooling apertures 65 are shown in FIG. 2 and exaggerated for clarity).

Combustor 56 further includes a combustor dome inlet 66 and a combustor outlet 68 formed through the upstream and trailing end portions of combustor 56, respectively. Combustor dome inlet 66 and effusion apertures 65 fluidly couple cavity 59 to combustion chamber 64, and combustor outlet 68 fluidly couples combustion chamber 64 to HPT nozzle assembly 58. A combustor dome shroud 70 is mounted to liner wall 61 and to liner wall 63 proximate the leading end portion of combustion chamber 64 and partially encloses combustor dome inlet 66. A carburetor assembly 72 is mounted within combustion chamber 64 proximate the leading end portion of combustor 56. Carburetor assembly 72 receives the distal end of a fuel injector 74, which extends radially inward from an outer portion of engine casing 48 as generally shown in FIG. 2. A diffuser 78 is mounted within engine casing 48 upstream of combustor 56; and an igniter 76 extends inwardly from main engine casing, through liner wall 63, and into combustion chamber 64.

During operation of GTE 20 (FIG. 1), diffuser 78 directs compressed air received from compressor section 26 into cavity 59. A portion of the compressed air supplied by diffuser 78 flows through combustor dome shroud 70 and into carburetor assembly 72. Carburetor assembly 72 mixes this air with fuel and air received from fuel injector 74 and introduces the resulting fuel-air mixture into combustion chamber 64. Within combustion chamber 64, the fuel-air mixture is ignited by igniter 76. The air heats rapidly, exits combustion chamber 64 via outlet 66, and flows into HPT nozzle assembly 58. HPT nozzle assembly 58 then directs the air through the sequential series of air turbines mounted within turbine section 30 (i.e., turbines 42, 44, and 46 shown in FIG. 1) to drive the rotation of the air turbines and, therefore, the rotation of the fan and compressor stages mechanically coupled thereto. In the embodiments wherein GTE 20 assumes the form of a turbojet, the air is subsequently exhausted (e.g., via an exhaust nozzle 80 provided in exhaust section 32 shown in FIG. 1) to produce upstream thrust.

A certain volume of the air supplied by diffuser 78 into cavity 59 is directed over and around combustor 56. As indicated in FIG. 2 by arrows 82, a first portion of this air flows along a first cooling flow path 84 generally defined by outer portion of liner wall 63 and an inner portion of engine casing 48. Similarly, as indicated in FIG. 2 by arrows 86, a second portion of the compressed air flows along a second cooling path 88 generally defined by an inner portion of liner wall 61 and an internal portion of engine casing 48. The air flowing along cooling flow paths 84 and 88 is considerably cooler than the air exhausted from combustion chamber 64. Airflow along cooling flow paths 84 and 88 is utilized to convectively cool combustor 56, HPT nozzle assembly 58, and the other components of combustion section 28 and turbine section 30. With respect to combustor 56, in particular, airflow along cooling flow paths 84 and 88 may convectively cool the exterior of liner walls 61 and 63 through direct convection. Furthermore, in embodiments wherein liner walls 61 and 63 are provided with effusion apertures 65, the air conducted along cooling flow paths 84 and 88 may also cool liner walls 61 and 63 via convection cooling through effusion apertures 65. Effusion apertures 65 may also help create a cool barrier air film along the inner surface of liner walls 61 and 63 defining combustion chamber 64. The combustion process (through radiation heat transfer) and flow of exhaust from combustor 56 (through convection), in concert with airflow along cooling flow paths 84 and 88, results in relative thermal movement between the various components of combustion section 28 and turbine section 30 as described more fully below.

Figure 3:
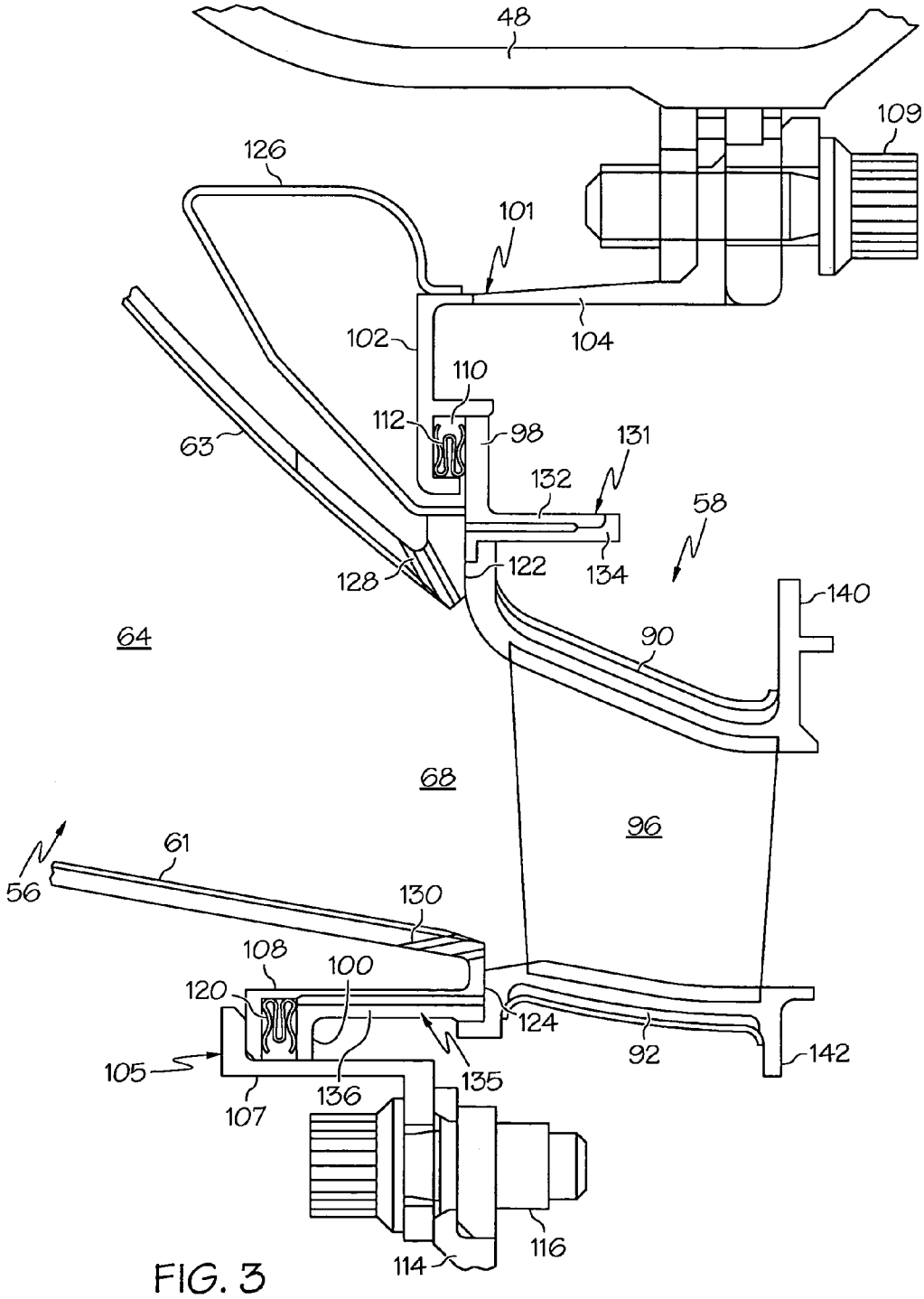
FIG. 3 is a cross-sectional view illustrating the trailing end portion of the combustor and the exemplary HPT nozzle assembly in greater detail.
Figure 4:
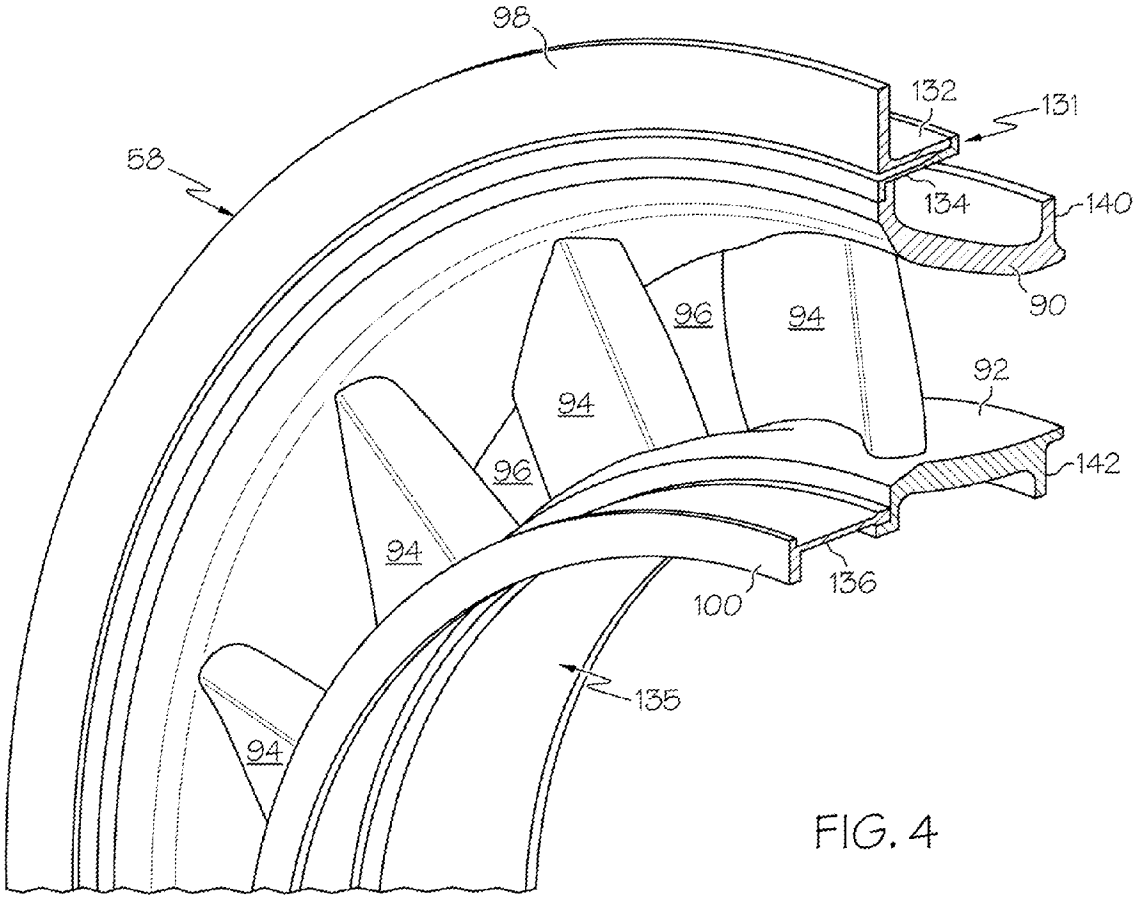
FIG. 4 is an isometric view of a quarter section of the exemplary HPT nozzle assembly illustrated in FIGS. 2-4.

FIG. 3 illustrates the trailing end portion of combustor 56 and HPT nozzle assembly 58 in greater detail. A quarter section of HPT nozzle assembly 58 is also illustrated isometrically in FIG. 4. Referring to FIGS. 3 and 4 in conjunction with FIG. 2, HPT nozzle assembly 58 includes an outer nozzle endwall 90 and an inner nozzle endwall 92. In the illustrated example, outer nozzle endwall 90 and inner nozzle endwall 92 each have a substantially annular geometry; however, in alternative embodiments of HPT nozzle assembly 58, outer nozzle endwall 90 and inner nozzle endwall 92 may be divided into a number of arcuate segments, which are circumferentially spaced about the longitudinal axis of GTE 20. Outer nozzle endwall 90 circumscribes inner nozzle endwall 92, which is substantially co-axial with outer nozzle endwall 90 and with the longitudinal axis of GTE 20. As shown most clearly in FIG. 4, a plurality of circumferentially spaced stator vanes 94 extends between outer nozzle endwall 90 and inner nozzle endwall 92. Collectively, outer nozzle endwall 90, inner nozzle endwall 92, and nozzle stator vanes 94 (FIG. 4) form a turbine nozzle flowbody having a plurality of flow passages 96 therethrough.

Figure 5:
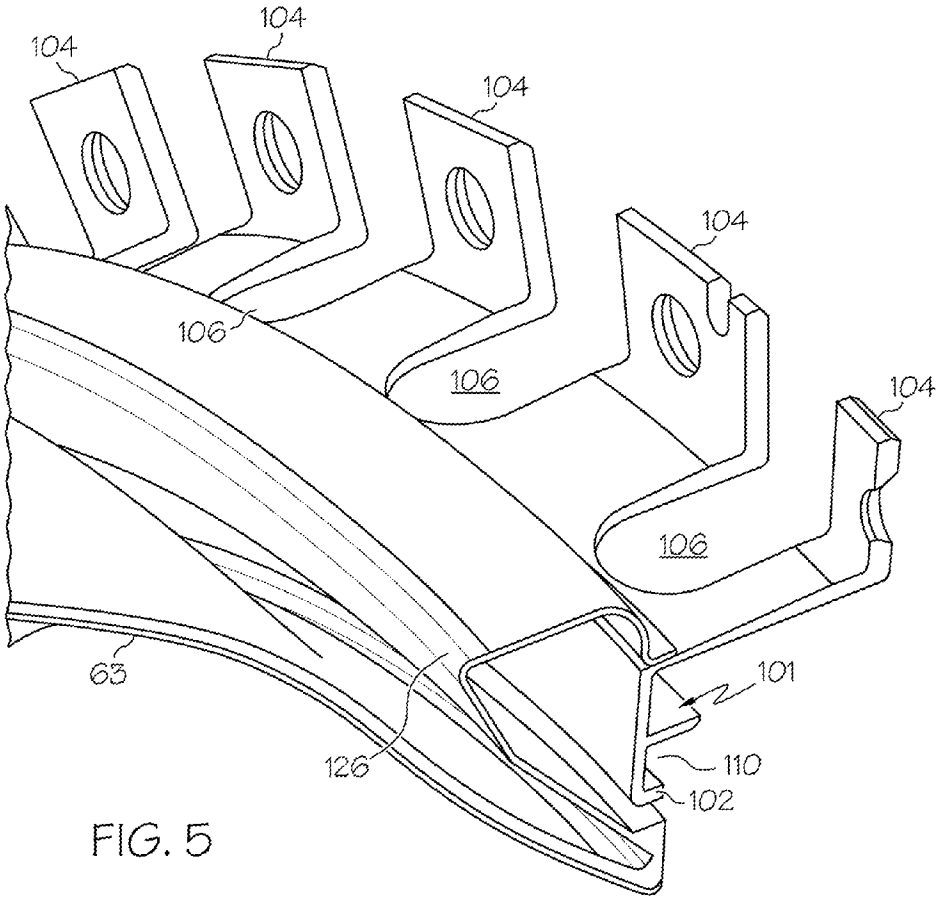
FIG. 5 is an isometric view of a section of an exemplary outer GTE-nozzle mounting interface to which the HPT nozzle assembly shown in FIGS. 2-4 may be mounted.

HPT nozzle assembly 58 further includes an outer mounting flange 98 and an inner mounting flange 100. Outer mounting flange 98 enables HPT nozzle assembly 58 to be mounted to an outer GTE-nozzle mounting interface 101 (FIG. 3) provided within engine casing 48. Similarly, inner mounting flange 100 permits HPT nozzle assembly 58 to be mounted to an inner GTE-nozzle mounting interface 105 (FIG. 3) also provided within engine casing 48. In the illustrated exemplary embodiment, outer GTE-nozzle mounting interface 101 assumes the form of an annular body 102 having a plurality of L-shaped tabs 104 extending axially therefrom. As may be appreciated by referring to FIG. 5, which is an isometric view of a section of outer GTE-nozzle mounting interface 101, L-shaped tabs 104 are radially spaced to define a plurality of airflow channels 106 through annular body 102. During operation of GTE 20, airflow channels 106 permit airflow through annular body 102 and, therefore, around the sealing interface between the trailing end of combustor 64 and HPT nozzle assembly 58 (described below). Airflow channels 106 also increase the flexibility of outer GTE-nozzle mounting interface 101 along the length of tabs 104 and, consequently, permit annular body 102 to better accommodate thermal displacement between outer GTE-nozzle mounting interface 101, engine casing 48, combustor 56, and HPT nozzle assembly 58. As illustrated in FIG. 3, each L-shaped tab 104 may be mounted to engine casing 48 utilizing, for example, a bolt 109 or other mechanical fastening means (e.g., a rivet). When mounted to engine casing 48 in this manner, outer GTE-nozzle mounting interface 101 engages outer mounting flange 98 to physically capture HPT nozzle assembly 58 and thereby help maintain the radial position thereof.

An annulus 110 is provided within annular body 102 of outer GTE-nozzle mounting interface 101. A compression seal 112 (FIG. 3) is disposed within annulus 110 and sealingly compressed between an inner surface of annular body 102 and an annular sealing surface (e.g., the leading radial face) of outer mounting flange 98. When maintained within an optimal temperature range (e.g., between approximately 500 and 1350 degrees Fahrenheit), compression seal 112 effectively minimizes or eliminates leakage between combustor 56 and HPT nozzle assembly 58. As indicated in FIG. 3, compression seal 112 can assume the form of a metallic W-seal; alternatively, compression seal 112 may assume various other geometries (e.g., that of a C-seal, a V-seal, various other convolute seals, or an elastic gasket configuration) and may be formed from other materials. In addition to carrying compression seal 112, annular body 102 also serves as a pilot to ensure precise radial alignment between the outer GTE-nozzle mounting interface 101 and HPT nozzle assembly 58. The foregoing notwithstanding, HPT nozzle assembly 58 may not include a compression seal in alternative embodiments and may instead be attached (e.g., bolted) directly to the outer GTE-nozzle mounting interface 101 to form a metal-to-metal seal.

As illustrated in FIG. 3, the trailing ends of outer liner walls 61 and 63 abut the leading ends of nozzle endwalls 90 and 92 to form first and second bearing seals 122 and 124, respectively. In addition, a compliant seal wall 126 is coupled between the trailing end of outer liner wall 63 and an outer surface of annular body 102. As can be appreciated by referring to FIG. 5, compliant seal wall 126 has a generally conical shape and circumscribes the downstream portion of combustor 56. Compliant seal wall 126, bearing seal 122, and compression seal 112 cooperate to help minimize or eliminate leakage between combustor 46 and HPT nozzle assembly 58. At the same time, compliant seal wall 126 provides a radial flexibility to accommodate relative movement between GTE-nozzle mounting interface 101, engine casing 48, and outer liner wall 63, which grows radially outward during combustion. Compliant seal wall 126 also provides an axial compliancy between engine casing 48 and the core components of GTE 20 (FIG. 1), which further helps to accommodate relative movement and to maintain a substantially constant axial load through compression seal 112 and bearing seal 122 to preserve the sealing characteristics thereof. If desired, one or more cooling channels may be formed through the trailing end portion of outer liner wall 63 to direct a cooling jet against the upstream portion of outer nozzle endwall 90 as indicated in FIG. 3 at 128. Similarly, one or more cooling channels may be provided through the trailing end portion of inner liner wall 61 to cool the upstream portion of inner nozzle endwall 92 as in FIG. 3 indicated at 130.

As previously noted, inner mounting flange 100 permits HPT nozzle assembly 58 to be mounted to an inner GTE-nozzle mounting interface 105 (FIG. 3). In the illustrated example, inner GTE-nozzle mounting interface 105 includes a flanged cylinder 107 and an axially-elongated beam 108. Flanged cylinder 107 is attached to an inner wall 114 of engine casing 48 utilizing, for example, a plurality of bolts 116 (only one bolt 116 is shown in FIG. 3 for clarity). Axially-elongated beam 108 extends from the trailing end portion of inner liner wall 61 in an upstream direction to abut an outer portion of flanged cylinder 107. The trailing end portion of axially-elongated beam 108 is joined to, and may be integrally formed with, the trailing end portion of inner liner wall 61. In the exemplary embodiment illustrated in FIG. 3, a second compression seal 120 (e.g., a convolute seal, such as a metallic W-seal) is sealingly disposed between a surface of axially-elongated beam 108 and the sealing surface (e.g., upstream face) of mounting flange 100. Compression seal 120 effectively minimizes or eliminates the formation of leakage paths between inner GTE-nozzle mounting interface 105 and HPT nozzle assembly 58 when maintained within an optimal temperature range. In alternative embodiments wherein HPT nozzle assembly 58 does not include a compression seal, inner mounting flange 100 may be attached (e.g., bolted) directly to a component of inner GTE-nozzle mounting interface 105.

With continued reference to FIGS. 3 and 4, HPT nozzle assembly 58 further includes two radially-compliant spring members: (i) an outer radially-compliant spring member 131, which includes an outer axially-elongated beam 132 and an inner axially-elongated beam 134, and (ii) an inner radially-compliant spring member 135, which includes a single axially-elongated beam 136. Outer radially-compliant spring member 131 is coupled between outer nozzle endwall 90 and outer mounting flange 98. More specifically, the leading end of outer axially-elongated beam 132 is joined to an inner portion of outer mounting flange 98, the trailing end of outer axially-elongated beam 132 is joined to the trailing end of inner axially-elongated beam 134, and the leading end of inner axially-elongated beam 134 is joined to the leading end of outer nozzle endwall 90. Outer axially-elongated beam 132, inner axially-elongated beam 134, and outer nozzle endwall 90 can be joined utilizing any suitable coupling means, including brazing, welding, and interference fit techniques. Outer axially-elongated beam 132 and outer mounting flange 98 may also be formed as separate pieces and subsequently joined together utilizing a conventional coupling means; however, as indicated in FIG. 3, it is preferred that outer axially-elongated beam 132 and outer mounting flange 98 are integrally formed as a single machined piece.

In the illustrated exemplary embodiment, axially-elongated beam 132 and inner axially-elongated beam 134 extend from outer mounting flange 98 and the leading end of outer nozzle endwall 90 in a downstream direction to accommodate the conical shape of outer liner wall 63; however, in alternative embodiments, axially-elongated beams 132 and 134 may extend from outer mounting flange 98 and outer nozzle endwall 90 in an upstream direction. It will be noted that axially-elongated beams 132 and 134 are referred as to "beams" herein to emphasize that, when taken as a cross-section, beams 132 and 134 each have a relatively high length-to-width aspect ratio and a corresponding flexibility. When considered in three dimensions, axially-elongated beams 132 and 134 each preferably have either an arcuate or an annular geometry. In the illustrated exemplary embodiment, and as shown most clearly in FIG. 4, outer axially-elongated beam 132 and inner axially-elongated beam 134 each assume the form of a substantially annular band, which extends around, and is preferably co-axial with, the longitudinal axis of GTE 20. Outer axially-elongated beam 132 circumscribes inner axially-elongated beam 134, which, in turn, circumscribes the leading end portion of outer nozzle endwall 90. Together, outer axially-elongated beam 132 and inner axially-elongated beam 134 cooperate to form a continuous 360 degree seal between outer nozzle endwall 90 and outer mounting flange 98. The axial length of axially-elongated beam 132 is preferably substantially equivalent to the axial length of axially-elongated beam 134 such that outer mounting flange 98 radially overlaps with the leading end of outer nozzle endwall 90 and the annular sealing surface of outer mounting flange 98 resides in substantially the same plane as does the leading edge of outer nozzle endwall 90. Due to this configuration, HPT nozzle assembly 58 can readily replace a conventional HPT nozzle having a radial mounting flange rigidly joined to, and extending radially from, the leading end portion of the outer nozzle endwall.

As do axially-elongated beams 132 and 134, axially-elongated beam 136 preferably assumes the form of a substantially annular band. However, in contrast to axially-elongated beams 132 and 134, axially-elongated beam 136 extends from the leading end portion of inner nozzle endwall 92 in an upstream direction and is circumscribed by inner liner wall 61. The trailing end of axially-elongated beam 136 is coupled (e.g., via welding, brazing, or interference fit) to the leading end of inner nozzle endwall 92. The leading end of axially-elongated beam 136 is, in turn, coupled to inner mounting flange 100; e.g., axially-elongated beam 136 can be integrally formed with inner mounting flange 100 as a unitary machined piece as generally illustrated in FIG. 3.

During operation of GTE 20 (FIG. 1), HPT nozzle assembly 58 conducts combustive gas flow from combustor 56 (FIGS. 1-3) into turbine section 30 to drive the rotation of HP turbine 42, IP turbine 44, and LP turbine 42 (FIG. 1) as described above. Due to their direct and prolonged exposure to the combustive gas flow, combustor 56 and the inner surface of HPT nozzle assembly 58 become relatively hot. Conversely, mounting flanges 98 and 100, GTE-nozzle mounting interfaces 101 and 105, and engine casing 48, which are remote from the combustive gas flow and which are cooled by the bypass air flowing over and around combustor 56, remain relatively cool. Thermal distortion consequently occurs between HPT nozzle assembly 58, GTE-nozzle mounting interfaces 101 and 105, and the trailing end of combustor 56. Radially-compliant spring members 131 and 135 flex radially to accommodate relative thermal movement between HPT nozzle assembly 58, outer GTE-nozzle mounting interface 101, and inner GTE-nozzle mounting interface 105. In so doing, radially-compliant spring members 131 and 135 reduce thermomechanical stress in HPT nozzle assembly 58, GTE-nozzle mounting interface 101, and GTE-nozzle mounting interface 105 and increase the overall operational lifespan of GTE 20 (FIG. 1).

In addition to alleviating thermomechanical stress, radially-compliant spring members 131 and 135 thermally isolate mounting flanges 98 and 100 from the combustive gas flow exhausted from combustor 56 and thereby help prevent to the overheating of compression seals 112 and 120, respectively. With respect to radially-compliant spring member 131, in particular, the combined axial length of beams 132 and 134 provides a relatively lengthy and tortuous heat transfer path having an increased surface area convectively cooled by the bypass air flowing over and around combustor 56. Notably, as beams 132 and 134 are elongated in an axial direction, outer mounting flange 98 maintains a low radial height profile (taken with respect to outer nozzle endwall 90). Thus, in contrast to certain conventional turbine nozzle designs employing a mounting flange of increased radial height, axially-elongated beams 132 and 134 provide superior thermal isolation of the sealing surface of mounting flange 98 without a significant increase in the overall envelope of HPT nozzle assembly 58. With respect to radially-compliant spring member 135, axially-elongated beam 136 likewise provides a relatively lengthy heat transfer path that is exposed to the cooler bypass air flowing over and around combustor 56. Axially-elongated beam 136 also provides an axial offset or excursion between the sealing surface of inner mounting flange 100 and the leading end portion of inner nozzle endwall 92 to further help thermally isolate compression seal 120 from the combustive gas flow.

The foregoing has thus provided an exemplary embodiment of a turbine nozzle assembly that accommodates relative thermal movement between the turbine nozzle assembly and the GTE-turbine nozzle mounting interface. Notably, the above-described embodiment of the turbine nozzle assembly is relatively compact and provides a mounting flange sealing surfaces sufficiently thermally isolated from the combustive gas flow to generally prevent the overheating of any compression seals disposed between the mounting flange and the GTE-turbine nozzle mounting interface. As a result, the sealing characteristics of the compression seals are maintained during GTE operation, and the formation of leakage paths is eliminated or minimized. Although, in the above-described exemplary embodiment, the outer radially-compliant spring member included two axially-elongated beams, the outer radially-compliant spring member may include a single axially-elongated beam in alternative embodiments; however, it is generally preferred that the outer radially-compliant spring member includes two radially-overlapping beams to increase flexibility, to permit the outer mounting flange to radially align with the leading edge of the turbine nozzle flowbody, and to provide a greater overall axial length to better thermally isolate the sealing surface of the outer mounting flange from the combustive gas flow.

Although not described above in the interests of concision, HPT nozzle assembly 58 may further include one or more trailing mounting flanges. For example, as shown in FIG. 3, HPT nozzle assembly 58 may further include: (i) an outer trailing mounting flange 140, which is coupled to and which extends radially outward from the trailing end portion of outer nozzle endwall 90; and (ii) an inner trailing mounting flange 142, which is coupled to and which extends radially outward from the trailing end portion of inner nozzle endwall 92. As will be readily appreciated, trailing mounting flanges 140 and 142 permit HPT nozzle assembly 58 to be mounted to corresponding GTE-nozzle mounting interfaces provided within engine casing 48 (not shown); e.g., a stationary component of turbine section 30 and/or an inner wall of engine casing 48. Furthermore, although not shown in FIG. 3, a radially-compliant spring member similar to spring member 131 or to spring member 135 may disposed between trailing mounting flange 140 and/or trailing mounting flange 142 to accommodate relative thermal movement, and thus alleviate thermomechanical stress, between HPT nozzle assembly 58 and the other components of GTE 20 as previously described.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A turbine nozzle assembly for deployment within a gas turbine engine (GTE) including a first GTE-nozzle mounting interface, the turbine nozzle assembly comprising:

a turbine nozzle flowbody, comprising:

an inner nozzle endwall; and an outer nozzle endwall fixedly coupled to the inner nozzle endwall and cooperating therewith to define a flow passage through the turbine nozzle flowbody;

an outer mounting flange configured to be mounted to the first GTE-nozzle mounting interface; and an outer radially-compliant spring member coupled between an end portion of the outer nozzle endwall and the outer mounting flange, the outer radially-compliant spring member accommodating relative thermal movement between the turbine nozzle flowbody and the outer mounting flange to alleviate thermomechanical stress during operation of the GTE, the outer radially-compliant spring member comprising a first axially-elongated beam extending from a leading end portion of the outer nozzle endwall in a downstream direction.

2. A turbine nozzle assembly according to claim 1 wherein the outer radially-compliant spring member further comprises a second axially-elongated beam coupled between the first axially-elongated beam and the outer mounting flange.

3. A turbine nozzle assembly according to claim 2 wherein the first axially-elongated beam overlaps radially with the second axially-elongated beam.

4. A turbine nozzle assembly according to claim 2 wherein the second axially-elongated beam is integrally formed with the outer mounting flange.

5. A turbine nozzle assembly according to claim 2 wherein the first axially-elongated beam comprises a first substantially annular band generally circumscribing the outer nozzle endwall.

6. A turbine nozzle assembly according to claim 5 wherein the second axially-elongated beam comprises a second substantially annular band generally circumscribing the first substantially annular band.

7. A turbine nozzle assembly according to claim 2 wherein the GTE further comprises a second GTE-nozzle mounting interface, and wherein the turbine nozzle assembly further comprises:

an inner mounting flange configured to be mounted to the second GTE-nozzle mounting interface; and an inner radially-compliant spring member coupled between the inner mounting flange and the leading end portion of the inner nozzle endwall, the inner radially-compliant spring member accommodating relative thermal movement between the inner nozzle endwall and the inner mounting flange to alleviate thermomechanical stress during operation of the GTE.

8. A turbine nozzle assembly according to claim 7 wherein the inner radially-compliant spring member comprises a third axially-elongated beam extending between the inner mounting flange and the leading end portion of the inner nozzle endwall.

9. A turbine nozzle assembly according to claim 8 wherein the inner mounting flange is axially offset from the leading edge of the inner nozzle endwall, and wherein the third axially-elongated beam extends from the leading edge of the inner nozzle sidewall in an upstream direction.

10. A turbine nozzle assembly according to claim 7 further comprising a compression seal sealingly deformed between the inner mounting flange and the inner radially-compliant spring member.

11. A turbine nozzle assembly according to claim 7 wherein the first axially-elongated beam, the second axially-elongated beam, and the third axially-elongated beam each extend along an axis substantially parallel to the longitudinal axis of the GTE.

12. A turbine nozzle assembly for deployment within a gas turbine engine (GTE) including a first GTE-nozzle mounting interface, the turbine nozzle assembly comprising:

a turbine nozzle flowbody, comprising:

an inner nozzle endwall; and an outer nozzle endwall fixedly coupled to the inner nozzle endwall and cooperating therewith to define a flow passage through the turbine nozzle flowbody;

an outer mounting flange configured to be mounted to the first GTE-nozzle mounting interface; and an outer radially-compliant spring member coupled between an end portion of the outer nozzle endwall and the outer mounting flange, the outer radially-compliant spring member accommodating relative thermal movement between the turbine nozzle flowbody and the outer mounting flange to alleviate thermomechanical stress during operation of the GTE, the outer radially-compliant spring member comprising:

a first axially-elongated beam comprising a first substantially annular band generally circumscribing the outer nozzle endwall; and a second axially-elongated beam coupled between the first axially-elongated beam and the outer mounting flange, the second axially-elongated beam comprising a second substantially annular band generally circumscribing the first substantially annular band and cooperating therewith to form a continuous 360 degree seal between the outer nozzle endwall and the outer mounting flange.

13. A turbine nozzle assembly according to claim 12 wherein the outer mounting flange comprises a substantially annular sealing surface, and wherein the turbine nozzle assembly further comprises a compression seal sealingly deformed between the substantially annular sealing surface and the first GTE-nozzle mounting interface.

14. A turbine nozzle assembly according to claim 13 wherein the outer mounting flange radially overlaps with the leading end portion of the outer nozzle endwall.

15. A turbine nozzle assembly for deployment within a gas turbine engine (GTE) including an inner GTE-nozzle mounting interface and an outer GTE-nozzle mounting interface, the turbine nozzle assembly comprising:

an outer nozzle endwall;

an inner nozzle endwall fixedly coupled to the outer nozzle endwall and cooperating therewith to define a flow passage through the turbine nozzle assembly;

an outer mounting flange configured to be mounted to the outer GTE-nozzle mounting interface;

an inner mounting flange configured to be mounted to the inner GTE-nozzle mounting interface;

an outer radially-compliant spring member coupled between the outer nozzle endwall and the outer mounting flange;

an inner radially-compliant spring member coupled between the inner nozzle endwall and the inner mounting flange, the inner radially-compliant spring member cooperating with the outer radially-compliant spring member to accommodate relative thermal movement between the outer nozzle endwall, the inner nozzle endwall, the outer mounting flange, and the inner mounting flange to alleviate thermomechanical stress during operation of the GTE; and a compression seal sealingly deformed between the inner mounting flange and the inner radially-compliant spring member.

16. A turbine nozzle assembly according to claim 15 wherein the outer radially-compliant spring member comprises at least one axially-elongated beam extending between an end portion of the outer nozzle endwall and the outer mounting flange along an axis substantially parallel to the longitudinal axis of the GTE, and wherein the inner radially-compliant spring member comprises at least one axially-elongated beam extending between an end portion of the inner nozzle endwall and the inner mounting flange along an axis substantially parallel to the longitudinal axis of the GTE.

17. A turbine nozzle assembly for deployment within a gas turbine engine (GTE) including an outer GTE-nozzle mounting interface, the turbine nozzle assembly comprising:

an outer nozzle endwall;

an inner nozzle endwall fixedly coupled to the outer nozzle endwall and cooperating therewith to define a flow passage through the turbine nozzle assembly;

an outer mounting flange configured to be mounted to the inner GTE-nozzle mounting interface, the outer mounting flange having a substantially annular sealing surface;

a compression seal sealingly deformed between the substantially annular sealing surface and the outer GTE-nozzle mounting interface; and an outer radially-compliant spring member comprising at least one axially-elongated beam extending between the outer nozzle endwall and the outer mounting flange, the outer radially-compliant spring member: (i) accommodating thermal movement between the turbine nozzle assembly and the outer GTE-nozzle mounting interface to alleviate thermomechanical stress during operation of the GTE, and (ii) further thermally isolating the substantially annular sealing surface of the outer mounting flange from the inner surfaces of the outer nozzle endwall to reduce the heating of the compression seal during operation of the GTE.

* * * * *